US010371154B2

(12) United States Patent
Jayaram et al.

(10) Patent No.: US 10,371,154 B2
(45) Date of Patent: Aug. 6, 2019

(54) APPARATUS, SYSTEM AND METHOD FOR PUMPING GASEOUS FLUID

(71) Applicant: Halliburton Energy Services, Inc., Houston, TX (US)

(72) Inventors: Shiv Jayaram, Houston, TX (US); Freddie George Walton, Midland, TX (US); David Thomas Jolly, Midland, TX (US); Steven Keith Tetzlaff, Owasso, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 1093 days.

(21) Appl. No.: 14/062,597

(22) Filed: Oct. 24, 2013

(65) Prior Publication Data

US 2014/0050570 A1 Feb. 20, 2014

Related U.S. Application Data

(63) Continuation-in-part of application No. 13/801,969, filed on Mar. 13, 2013, now abandoned.

(60) Provisional application No. 61/675,578, filed on Jul. 25, 2012.

(51) Int. Cl.

| | |
|---|---|
| ***F04D 9/00*** | (2006.01) |
| ***F04D 13/08*** | (2006.01) |
| ***F04D 13/10*** | (2006.01) |
| ***F04D 31/00*** | (2006.01) |

(52) U.S. Cl.

CPC ..... *F04D 13/08* (2013.01); *F04D 9/003* (2013.01); *F04D 13/10* (2013.01); *F04D 31/00* (2013.01)

(58) Field of Classification Search

CPC ..... F04D 13/08; F04D 13/086; F04D 13/10; F04D 25/0686; F04D 29/2216; F04D 29/242

USPC ..... 415/1, 199.2; 416/203, 223 B

See application file for complete search history.

(56) References Cited

U.S. PATENT DOCUMENTS

| | | | | |
|---|---|---|---|---|
| 1,448,925 | A | | 3/1923 | Fulton et al. |
| 1,959,703 | A | * | 5/1934 | Birmann ..... F01D 5/048 415/115 |
| 2,236,953 | A | | 4/1941 | Schott |
| 3,215,083 | A | | 11/1965 | Sarles et al. |
| 3,265,001 | A | | 8/1966 | Deters |
| 3,424,372 | A | | 1/1969 | Blattner et al. |

(Continued)

*Primary Examiner* — Richard A Edgar
*Assistant Examiner* — Elton K Wong
(74) *Attorney, Agent, or Firm* — McGuireWoods LLP

(57) ABSTRACT

An apparatus, system and method for pumping gaseous fluid are described. The gas separator of the invention homogenizes at least a portion of produced well fluid and vents unhomogenized gas, improving the efficiency and decreasing the downtime of the assembly. A system for pumping gaseous fluid from an underground well includes a gas separator, the gas separator including an impeller configured to homogenize at least a portion of a gas and a liquid in a pumped fluid to obtain homogenized fluid, the impeller including a top side open to the diffuser and a truncated vane located at a mid-pitch location between at least two untruncated vanes starting from a bottom side of the impeller, and a gas separation chamber downstream of the impeller, the gas separation chamber configured to vent an unhomogenized gas, and a centrifugal pump arranged to receive the homogenized fluid from the gas separation chamber.

22 Claims, 12 Drawing Sheets

(56) References Cited

U.S. PATENT DOCUMENTS 3,951,565 A * 4/1976 Rothe ..... F04D 29/24 415/1
4,093,401 A * 6/1978 Gravelle ..... F04D 29/284 415/143
4,149,825 A * 4/1979 Grennan ..... F04D 29/2277 415/11
4,275,988 A * 6/1981 Kalashnikov ..... B01F 7/081 415/143
4,330,306 A 5/1982 Salant
4,481,020 A 11/1984 Lee et al.
5,002,461 A * 3/1991 Young ..... F04D 29/284 416/183
5,588,486 A 12/1996 Heinrichs
5,628,616 A * 5/1997 Lee ..... F04D 29/2288 415/199.1
5,639,217 A * 6/1997 Ohtsuki ..... F04D 29/284 416/183
5,653,286 A 8/1997 McCoy et al.
5,845,709 A 12/1998 Mack et al.
6,068,444 A * 5/2000 Sheth ..... F04D 1/06 415/104
6,312,216 B1 * 11/2001 Falcimaigne ..... F04D 31/00 415/211.2
6,508,626 B1 1/2003 Sakurai et al.
6,547,514 B2 4/2003 Lee
6,676,366 B2 1/2004 Kao
6,723,158 B2 4/2004 Brown et al.
6,755,250 B2 6/2004 Hall et al.
6,893,207 B2 * 5/2005 Kao ..... F04D 29/2288 415/58.2
7,094,016 B1 * 8/2006 Zaher ..... F04D 31/00 415/1
7,179,050 B2 * 2/2007 Hopfensperger ... F04D 29/4233 415/204
7,241,104 B2 7/2007 Wilson et al.
7,270,178 B2 9/2007 Selph
7,549,837 B2 6/2009 Hackworth et al.
7,766,081 B2 8/2010 Brown et al.
8,066,476 B2 11/2011 Orban et al.
8,070,426 B2 12/2011 Brunner et al.
8,162,600 B2 * 4/2012 Brown ..... F04D 29/44 415/199.2
8,491,277 B2 7/2013 Kawabata et al.
8,568,081 B2 10/2013 Song et al.
8,747,078 B2 6/2014 Brown et al.
8,919,432 B1 12/2014 Tetzlaff et al.
8,955,598 B2 2/2015 Brown et al.
9,719,523 B2 8/2017 Jayaram et al.
2005/0186065 A1 * 8/2005 Wilson ..... E21B 43/128 415/1
2007/0235195 A1 * 10/2007 Lawson ..... F04B 47/06 166/352
2010/0319926 A1 * 12/2010 Reid ..... E21B 43/128 166/372
2011/0173975 A1 * 7/2011 Sun ..... F02B 47/08 60/605.2

* cited by examiner

APPARATUS, SYSTEM AND METHOD FOR PUMPING GASEOUS FLUID

CROSS REFERENCE TO RELATED APPLICATIONS

The present application is a continuation-in-part of application Ser. No. 13/801,969 to Jayaram et al., filed Mar. 13, 2013, which claims the benefit of U.S. Provisional Application No. 61/675,578 to Jayaram et al., filed Jul. 25, 2012 and entitled "APPARATUS, SYSTEM AND METHOD FOR PUMPING GASEOUS FLUID," each of which are hereby incorporated by reference in their entireties.

BACKGROUND OF THE INVENTION

1. Field of the Invention

Embodiments of the invention described herein pertain to the field of electric submersible pump assemblies. More particularly, but not by way of limitation, one or more embodiments of the invention enable an apparatus, system and method for pumping gaseous fluid in electric submersible pump down-hole applications.

2. Description of the Related Art

Fluid, such as gas, oil or water, is often located in underground formations. In such situations, the fluid must be pumped to the surface so that it can be collected, separated, refined, distributed and/or sold. Centrifugal pumps are typically used in electric submersible pump applications for lifting well fluid to the surface. Centrifugal pumps impart energy to a fluid by accelerating the fluid through a rotating impeller paired with a stationary diffuser. The rotation confers angular momentum to the fluid passing through the pump. The angular momentum converts kinetic energy into pressure, thereby raising the pressure on the fluid and lifting it to the surface. Multiple stages of impeller and diffuser pairs may be used to further increase the pressure.

Conventional centrifugal pump assemblies are designed to handle fluid consisting mainly of liquids. However well fluid often contains gas in addition to liquid. Currently available submersible pump systems are not appropriate for pumping fluid with a high gas to liquid ratio, also termed a high gas volume fraction (GVF). Particularly, submersible pump systems need to be better suited to manage gas contained in well fluid. When pumping gas laden fluid, the gas may separate from the other fluid due to the pressure differential created when the pump is in operation. The separated gas forms bubbles in the liquid. If there is a sufficiently high GVF, typically around 10% to 15%, the pump may experience a decrease in efficiency and decrease in capacity or head (slipping). If gas continues to accumulate on the suction side of the impeller, gas bubbles may entirely block the passage of other fluid through the impeller. When this occurs the pump is said to be "gas locked" since proper operation of the pump is impeded by the accumulation of gas. As a result, careful attention to gas management in submersible pump systems is needed in order to improve the production of gas laden fluid from subsurface formations.

A typical impeller of a centrifugal pump is shown in FIGS. 1A and 1B. In FIG. 1A, closed impeller 100 is shown with six evenly spaced conventional vanes 105. For illustration purposes only, upper conventional shroud 110 and lower conventional shroud 115 are shown in FIG. 1B, but are not shown in FIG. 1A. FIG. 1B shows a cross sectional view of closed impeller 100 with two conventional shrouds, upper conventional shroud 110 and lower conventional shroud 115. In FIG. 1B, conventional hub 125 is long and hollow and connected to lower conventional shroud 115, upper conventional shroud 110 and conventional vanes 105. Conventional hub 125 slides over conventional shaft 130 and is keyed to conventional shaft 130, which causes closed impeller 100 to rotate with conventional shaft 130. Closed impeller 100 rotates counterclockwise or clockwise with shaft 130. Apertures 120 (shown in FIG. 1A) balance the pressure on each side of closed impeller 100. Conventional closed impeller 100 has a suction specific speed of about 6000.

Closed impeller 100 is paired with a conventional stationary diffuser, such as that shown in FIG. 2, such that each impeller rotates within (inward of) the diffuser to which it is paired. The diffuser does not rotate, but is mounted coaxially with the impeller and nests on the diffuser of the previous stage. Typically there is a clearance gap between the diffuser and impeller to which it is paired. This conventional clearance gap is typically about 0.015 inches to about 0.02 inches in width for conventional semi-open impellers.

Currently, gas separators are sometimes used in pump assemblies in an attempt to address the problems caused by gas in produced fluid. In such instances, a gas separator typically replaces the intake section of a pump assembly in a well containing fluid with a high GVF, with the upstream end of the intake including ports to take in well fluid. Gas separators attempt to remove gas from produced fluid prior to the fluid's entry into the pump section of the assembly. These separators, which also include a rotating shaft through their center, employ the inertia of rotating motion to separate fluid of varying density. There are two main types of gas separators, vortex and rotary. FIGS. 8A and 8B illustrate gas separators of the prior art. FIG. 8A is a rotary gas separator of the prior art. FIG. 8B is a vortex gas separator of the prior art. However it is often infeasible, costly or too time consuming to ascertain the correct type of pump and separator combination which might be effective for a particular well, and even if the correct arrangement is ascertained, the separator may not remove enough gas to prevent a loss in efficiency and/or prevent gas locking.

In the case of an electric submersible pump (ESP), a failure of the pump or any support components in the pump assembly can be catastrophic as it means a delay in well production and having to remove the pump from the well for repairs. A gas separator for a submersible pump assembly capable of reducing bubble size, homogenizing produced gaseous fluid and venting unhomogenized gas would be an advantage in all types of submersible assemblies.

Currently available pump assemblies do not contain components to satisfactorily homogenize gas laden fluid and prevent gas locking. This shortcoming decreases the efficiency and overall effectiveness of the pump assembly. Therefore, there is a need for an apparatus, system and method for pumping gaseous fluid in electric submersible pump applications.

BRIEF SUMMARY OF THE INVENTION

One or more embodiments of the invention enable an apparatus, system and method for pumping gaseous fluid.

An apparatus, system and method for pumping gaseous fluid are described. An electric submersible pump (ESP) of an illustrative embodiment comprises a gas separator, the gas separator comprising an impeller inward of a diffuser, the impeller comprising a top side and a bottom side, the top side open to the diffuser, and wherein the impeller further comprises a single shroud located on the bottom side of the impeller and arranged radially about a hub, an untruncated vane extending substantially upstream from the single shroud, and a truncated vane extending substantially upstream from the single shroud, and a centrifugal pump, the centrifugal pump fluidly coupled to the gas separator and arranged to receive substantially homogenized fluid from the gas separator. In some embodiments, the impeller further comprises an inlet area, the inlet area between about 1.75 and about 2.5 times a size of a conventional inlet area. In some embodiments, the impeller comprises at least two untruncated vanes extending substantially upstream from the single shroud and at least two truncated vanes extending substantially upstream from the single shroud, wherein each truncated vane sits at a mid-pitch location between untruncated vanes starting from the bottom side of the impeller. In some embodiments, the truncated vanes are between about 50% and about 75% of a chord length of the untruncated vanes. In some embodiments, the gas separator comprises an increased clearance gap between the impeller and the diffuser. In certain embodiments, the increased clearance gap is between about 0.060 inches and about 0.180 inches wide. In some embodiments, the impeller is configured to operate at about 8000 to about 12000 suction specific speed.

A system for pumping gaseous fluid from an underground well of an illustrative embodiment comprises a gas separator, the gas separator comprising an impeller configured to homogenize at least a portion of a gas and a liquid in a pumped fluid to obtain homogenized fluid, the impeller comprising a top side open to the diffuser, and a truncated vane located at a mid-pitch location between at least two untruncated vanes starting from a bottom side of the impeller; and a gas separation chamber downstream of the impeller, the gas separation chamber configured to vent an unhomogenized gas, and a centrifugal pump arranged to receive the homogenized fluid from the gas separation chamber. In some embodiments the system further comprises a bushing and a flanged sleeve located directly upstream of a hub of the impeller. In some embodiments, the impeller comprises three untruncated vanes and three truncated vanes, wherein each truncated vane sits at a mid-pitch location between the untruncated vanes. In some embodiments the system comprises a diffuser, wherein a clearance gap between the impeller and the diffuser is between about 0.060 inches and about 0.180 inches wide. In some embodiments, the truncated vane is between about 50% and about 75% of a chord length of the untruncated vane. In some embodiments, the impeller comprises an increased inlet area, the increased inlet area between about 1.75 and about 2.5 times a size of a conventional inlet area.

Illustrative embodiments of a method for pumping gaseous fluid comprises placing an electric submersible pump assembly into a well containing a gaseous fluid, the assembly comprising a gas separator and a centrifugal pump, operating the assembly to induce the fluid to flow towards the surface of the well, minimizing phase separation of the fluid using an impeller located in the gas separator to obtain substantially homogenized fluid, removing an unhomogenized gas from the assembly in a gas separation chamber of the gas separator; and lifting the homogenized fluid to the surface using the centrifugal pump. In some embodiments, the pressure differential is reduced by increasing an inlet area of the impeller. In some embodiments, the inlet area is increased by replacing an impeller vane of the impeller with a truncated vane. In some embodiments, the impeller comprises at least two untruncated vanes, and wherein the truncated vane is placed at a mid-pitch location between the at least two untruncated vanes starting from a bottom side of the impeller. In some embodiments the method further comprises the step of carrying at least a portion of the axial thrust on the centrifugal pump with a flanged sleeve and a bushing located directly upstream of the impeller. In some embodiments, the method further comprises the step of causing at least a portion of the fluid to flow through an increased clearance gap between the impeller and a diffuser. In certain embodiments, the increased clearance gap is between about 0.060 inches and about 0.180 inches wide.

Illustrative embodiments of an impeller for an electric submersible pump assembly comprises a top side and a bottom side, the top side open to a diffuser, a single shroud located on the bottom side of the impeller and arranged radially about a hub, at least two untruncated vanes extending substantially upstream from the single shroud, at least two truncated vanes extending substantially upstream from the single shroud, and wherein each truncated vane sits at a mid-pitch location between untruncated vanes starting from the bottom side of the impeller.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the illustrative embodiments will be more apparent from the following more particular description thereof, presented in conjunction with the following drawings wherein.

Figure 1A:
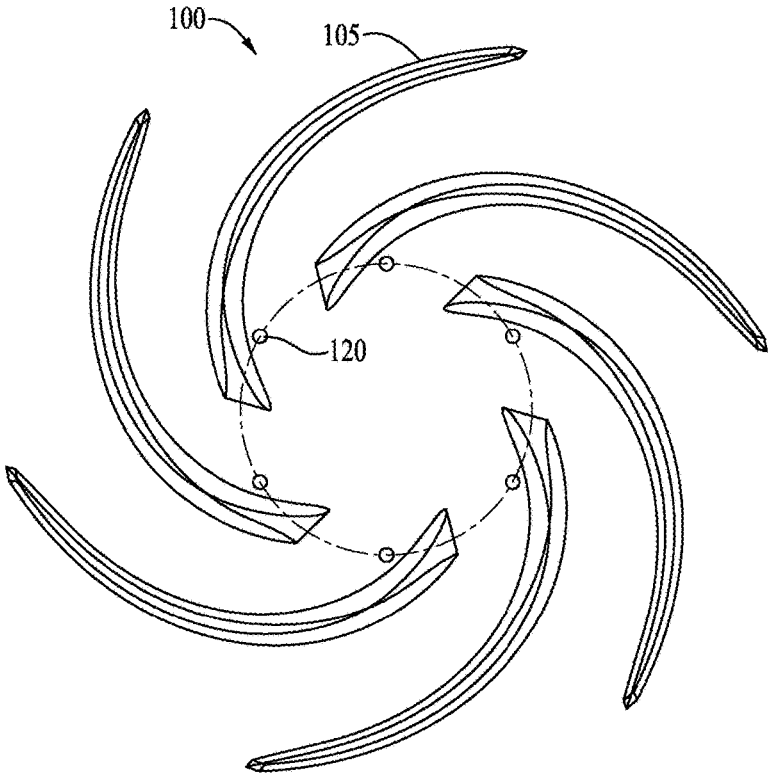
FIG. 1A PRIOR ART
FIG. 1A illustrates a plan view of an impeller of the prior art.
Figure 1B:
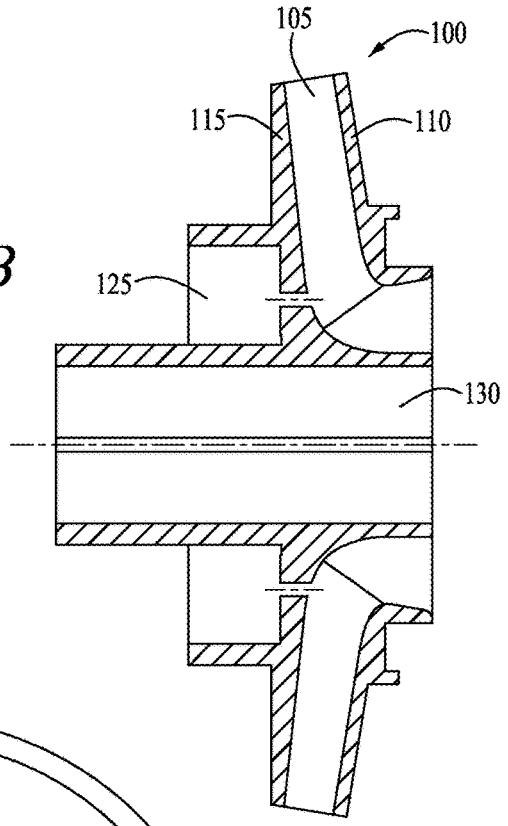
FIG. 1B PRIOR ART
FIG. 1B illustrates a cross sectional view of an impeller of the prior art.
Figure 2:
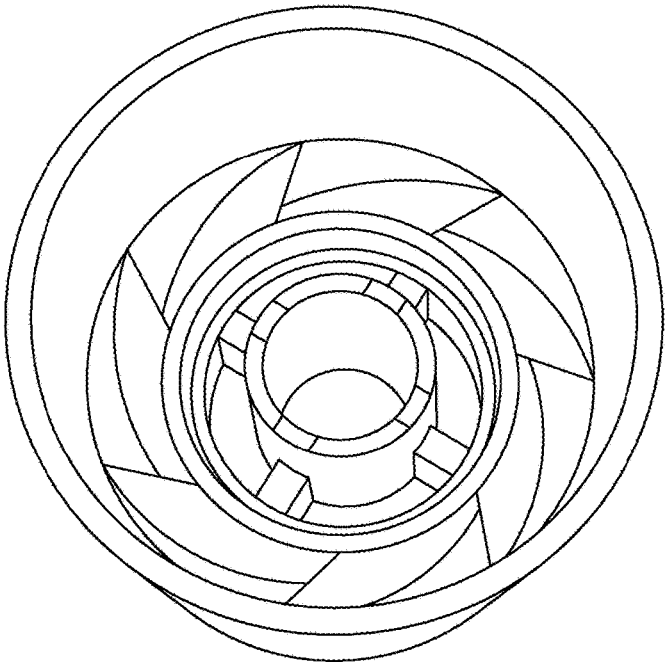
FIG. 2 PRIOR ART
FIG. 2 illustrates a perspective view of a diffuser of the prior art.

While the invention is susceptible to various modifications and alternative forms, specific embodiments thereof are shown by way of example in the drawings and may herein be described in detail. The drawings may not be to scale. It should be understood, however, that the embodiments described herein and depicted in the drawings are not intended to limit the invention to the particular form disclosed, but on the contrary, the intention is to cover all modifications, equivalents and alternatives falling within the spirit and scope of the present invention as defined by the appended claims.

DETAILED DESCRIPTION

An apparatus, system and method for pumping gaseous fluid will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a vane includes one or more vanes.

"Coupled" refers to either a direct connection or an indirect connection (e.g., at least one intervening connection) between one or more objects or components. The phrase "directly attached" means a direct connection between objects or components.

"Bottom" or "lower" side of an impeller refers to the substantially downstream side of an impeller.

"Top" or "upper" side of an impeller refers to the substantially upstream side of an impeller.

"Downstream" refers to the direction substantially with the primary flow of fluid when the centrifugal pump is in operation.

"Upstream" refers to the direction substantially opposite the primary flow of fluid when the centrifugal pump is in operation.

"Homogenize," means, with respect to a fluid containing gas and liquid, to sufficiently reduce the size of gas bubbles in the fluid, such that the fluid acts substantially similar to a single-phase liquid as it moves through an ESP pump.

One or more embodiments of the invention provide an apparatus, system and method for pumping gaseous fluid for use in electric submersible pump applications. While the invention is described in terms of an oil or water production embodiment, nothing herein is intended to limit the invention to that embodiment.

The invention disclosed herein includes an apparatus, system and method for pumping gaseous fluid. Illustrative embodiments of the invention enable substantially all gases to be either homogenized with or separated from produced fluid to allow a submersible pump to operate without gas locking. In some embodiments, after intake into the pump assembly, gas laden fluid may be rotated by an ESP assembly including a semi-open impeller. In some embodiments, the semi-open impeller may be located in the centrifugal pump. In other embodiments, the semi-open impeller may be located in a gas separator. In some embodiments, the semi-open impeller includes only a single shroud arranged radially about a hub. In some embodiments, a truncated vane and an untruncated vane, which may be arranged circumferentially about the hub, may extend substantially upstream from the single shroud. In some embodiments, the truncated vane may be located at a mid-pitch location between two untruncated vanes starting from the bottom side of the impeller. In certain embodiments, the impeller may include two, three or four of each truncated and untruncated vanes which alternate around the hub. In some embodiments, the impeller may include an increased inlet area. In some embodiments, there may be an increased clearance gap between the impeller and a diffuser, through which the fluid may flow. In some embodiments, a gas separator including the semi-open impeller of illustrative embodiments may reduce gas bubble size, homogenize a portion of the gas laden fluid and vent unhomogenized gas, sending substantially homogenized fluid to the centrifugal pump.

The features of the invention may minimize phase separation of the fluid by reducing the pressure differential between the pressure side and suction side of an impeller vane. This may reduce gas bubble size, homogenize the liquid and gas in the fluid, increase the efficiency and performance of the pump, prevent gas locking and reduce the producing well's downtime. When used in a gas separator, the features of illustrative embodiments may homogenize at least a portion of the liquid and gas in the fluid, after which any remaining unhomogenized gas may be removed from the pump assembly by the gas separator prior to the fluid's entry into the pump. Illustrative embodiments of the invention may homogenize or remove about 100% of gas in well fluid. Illustrative embodiments reduce the quantity of unhomegenized gas, making greater pump and gas separator combinations effective in preventing gas locking, and thereby improving the feasibility of finding a suitable pump and gas separator combination.

In some embodiments, the vanes of the present disclosure are arranged such that there is a larger inlet area of the impeller than in conventional impeller designs. Specifically, the reduction in the number of untruncated vanes and addition of one or more truncated vanes of the present disclosure provide for additional open space in the inlet region of the impeller. The impeller of an illustrative embodiment may have between about 1.75 and 2.5 times the size of the inlet area of a conventional impeller. The additional open space may reduce the velocity of the fluid passing through the impeller, which assists in maintaining high positive pressure at the impeller inlet. The impeller of the present disclosure is capable of operating with higher suction specific speed as compared to conventional impellers. In some embodiments, the impeller of the present disclosure may operate at about 8000 to about 12000 suction specific speed.

Figure 3:
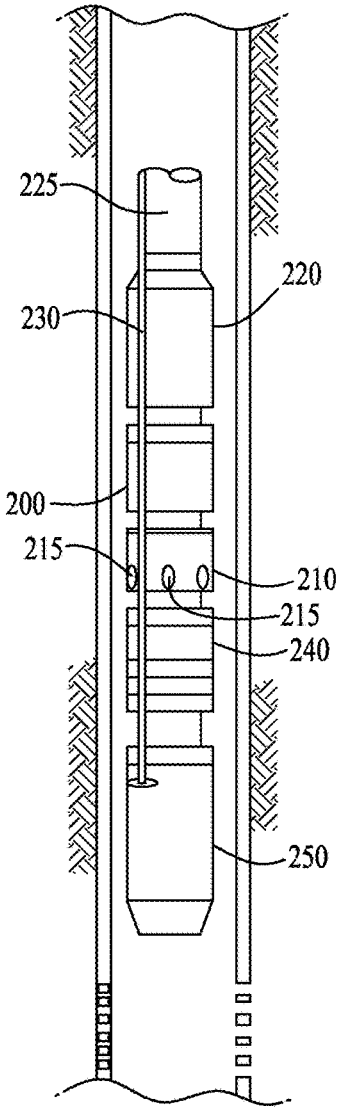
FIG. 3 illustrates one embodiment of an exemplary electric submersible pump (ESP) assembly.
Figure 9:
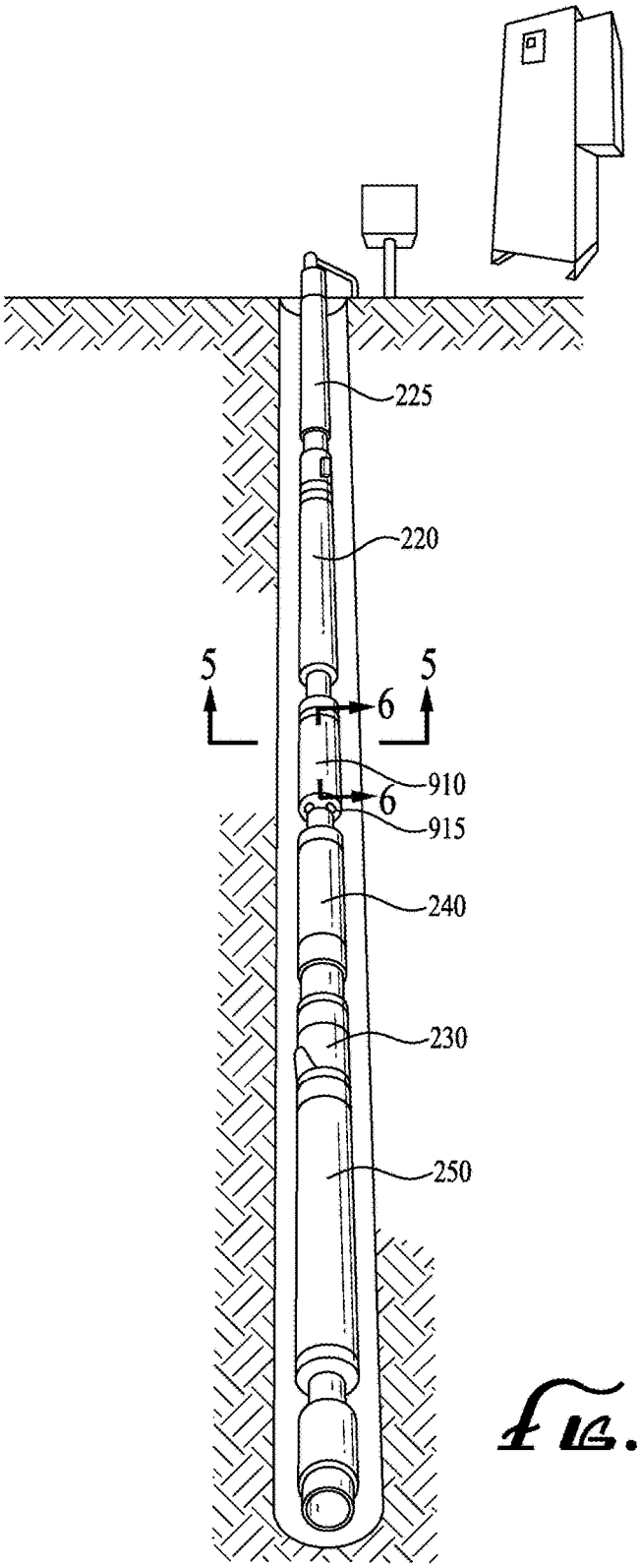
FIG. 9 illustrates one embodiment of an exemplary electric submersible pump (ESP) assembly including a gas separator.

The invention includes a centrifugal pump, or a gas separator and centrifugal pump, for electric submersible pump (ESP) systems. FIG. 3 illustrates one embodiment of an exemplary ESP assembly without a gas separator for use in the system of the invention. FIG. 9 illustrates one embodiment of an exemplary ESP assembly with gas separator for use in the system of the invention. In either case, the assembly may be located in an underground well during operation.

As shown in FIG. 3, ESP primary pump 220 and production tubing string 225 are downstream of ESP charge pump 200. In some embodiments, motor lead extension 230 may plug into ESP motor 250 at one end and may be spliced to another larger cable than runs the length of the well bore to a junction box and/or a control panel on the surface of the well site. Production tubing string 225 may be a conduit for the produced well fluid to flow from the reservoir towards the surface. ESP seal 240 sits between ESP motor 250 and ESP intake 210 and may protect ESP motor 250 from well fluid. As shown in the ESP assembly of FIG. 3, a semi-open impeller of an illustrative embodiment may be included in ESP charge pump 200, which is located downstream of ESP intake 210. Fluid enters the ESP assembly through fluid intakes 215 on ESP intake 210. The ESP charge pump 200 of an illustrative embodiment may homogenize fluid prior to the fluid entering ESP primary pump 220. In some embodiments, a semi-open impeller of illustrative embodiments may instead be included in ESP primary pump 220. Rotating shafts (not shown) pass through the center of the assembly components, causing fluid entering the assembly to rotate. ESP primary pump 220 and/or ESP charge pump 200 may be centrifugal pumps.

In some embodiments, a gas separator may be located between ESP intake 210 and ESP charge pump 200 of FIG. 3 to reduce the gas content of the fluid prior to the fluid entering ESP primary pump 220 and/or ESP charge pump 200. In some embodiments, a gas separator may eliminate the need for an ESP charge pump. When used, the gas separator may be the intake surface for the ESP pump system.

In certain embodiments, a semi-open impeller of an illustrative embodiment may be employed, not in ESP charge pump 200 or ESP primary pump 220, but in a gas separator to homogenize gas and liquid and separate unhomegenized gas from the homogenized fluid, prior to the fluid's entry into ESP charge pump 200 and/or ESP primary pump 220. FIG. 9 illustrates one embodiment of an exemplary ESP assembly with gas separator for use in illustrative embodiments. As shown in FIG. 9, fluid enters port 915 located on gas separator 910. Gas separator 910 may employ the semi-open impeller of illustrative embodiments to first homogenize at least a portion of the gas and liquid in the well fluid, and may subsequently vent any remaining unhomogenized gas to the annulus (shown in FIGS. 10 and 11) of the separation chamber (shown in FIGS. 10 and 11) of gas separator 910, thereby reducing or eliminating gas contained in the fluid continuing on to ESP primary pump 220. Gas separator 910 may be a rotary or vortex type separator.

Figure 4A:
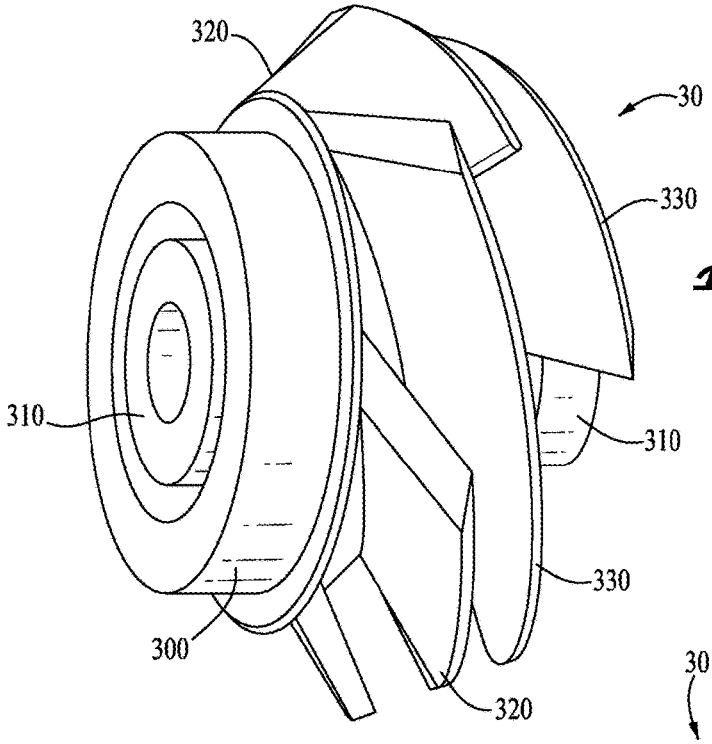
FIG. 4A illustrates a perspective view of one embodiment of a semi-open impeller.
Figure 4B:
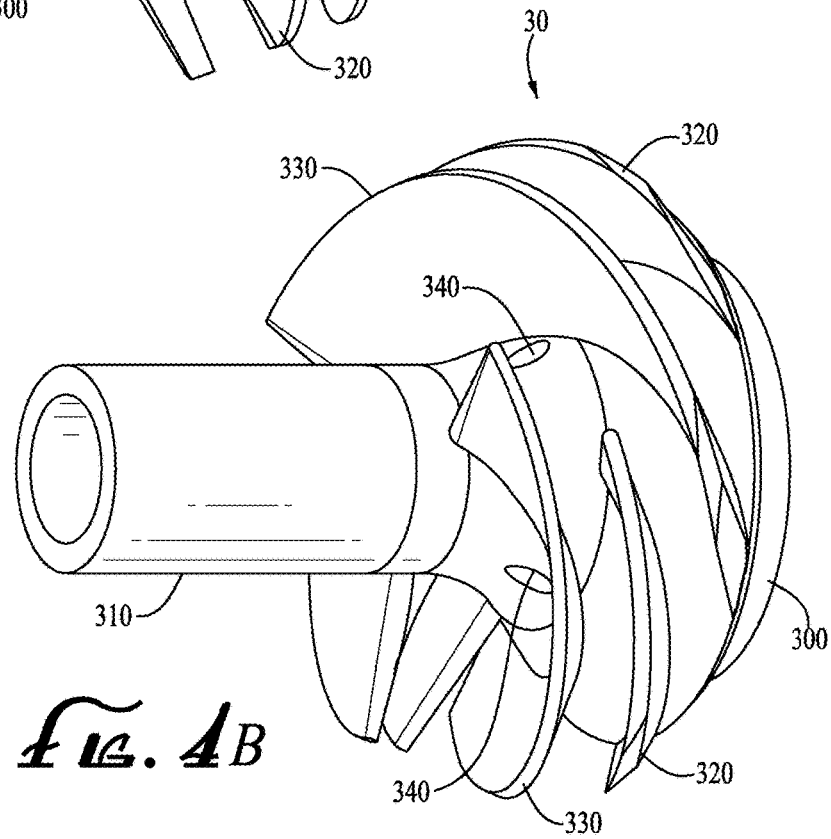
FIG. 4B illustrates a perspective view of one embodiment of a semi-open impeller.

FIGS. 4A and 4B illustrate perspective views of one exemplary embodiment of a semi-open impeller of an illustrative embodiment. Impeller 30 may include single shroud 300 arranged radially about hub 310. Truncated vane 320 and untruncated vane 330 may extend substantially upstream from single shroud 300. In some embodiments, truncated vane 320 sits at a mid-pitch location between two untruncated vane 330 starting from the bottom side of impeller 30. In certain embodiments, truncated vane 320 alternates with untruncated vane 330, which vanes 320, 330 are circumferentially disposed about hub 310. In some embodiments there are two, three or four of each truncated vane 320 and untruncated vane 330 disposed about hub 310. Greater or fewer number of vanes 320, 330 may also be used. In certain embodiments, the number of truncated vane 320 varies from the number of untruncated vane 330 and/or the vanes 320, 330 may not strictly alternate. In FIG. 4B, balance hole 340 are also shown on impeller 30 and assist in equalizing the pressure on each side of impeller 30. In some embodiments, impeller 30 may operate at about 8000 to about 12000 suction specific speed. In some embodiments, truncated vane 320 may increase the performance of a pump's head flow and efficiency and maintain high net positive suction pressure, without sacrificing suction performance.

Figure 5:
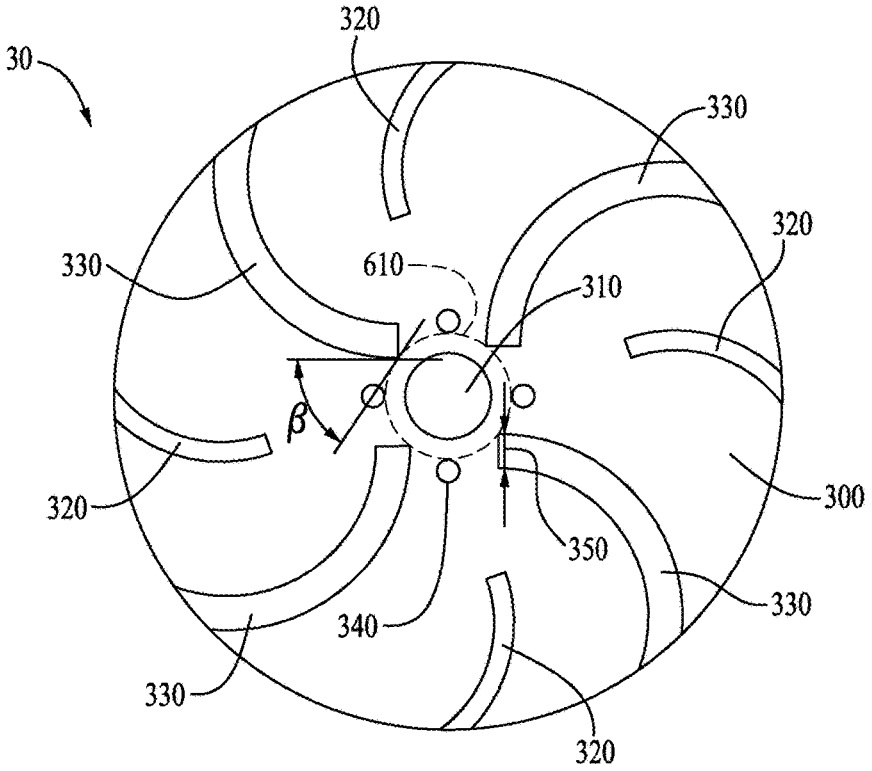
FIG. 5 is a partial cross sectional view taken along line 5-5 of FIG. 9 of one embodiment of an impeller installed in a gas separator.

FIG. 5 is a partial cross sectional view taken along line 5-5 of FIG. 9 of one illustrative embodiment of an impeller for an ESP assembly. FIG. 5 illustrates one embodiment of single shroud 300 and the arrangement of vanes 320, 330 disposed about hub 310 of impeller 30. In some embodiments, truncated vane 320 is between about 50% and 75% the chord length of untruncated vane 330 (as judged from hub 310 and extending from the outer circumference of single shroud 300). In certain embodiments, truncated vane 320 may be shorter or longer but always shorter in chord length than untruncated vane 330. In some embodiments, a centrifugal pump and/or gas separator of an illustrative embodiment may include abrasion resistant trim, such as busing 560 and flanged sleeve 570 (shown in FIG. 6) to increase the lifespan of the centrifugal pump in the instance that solids are also present in the produced well fluid.

In some embodiments the arrangement of vanes 320, 330 create inlet area 610 of impeller 30 between about 1.75 and about 2.5 times the size of the inlet area of a conventional impeller. One embodiment of inlet area 610 is illustrated in FIG. 6A. As shown in FIG. 6A, the size of inlet area 610 may be calculated using the formula:

$$\text{Inlet Area}=2\pi RH-B$$

where R is mean inlet radius 620 as measured from centerline 640, H is inlet vane height 630 and B is the vane blockage. The vane blockage may be calculated as follows:

$$\text{Vane Blockage} = NH\frac{T}{\sin\beta}$$

where N is the number of untruncated vane 330 in impeller 30, H is inlet vane height 630, T is vane thickness 350 (shown in FIG. 5) and β is the inlet vane angle (shown in FIG. 5).

As truncated vane 320 do not contribute to vane blockage, the arrangement of vanes 320, 330 of an illustrative embodiment reduce the vane blockage and thereby increase inlet area 610.

Figure 6:
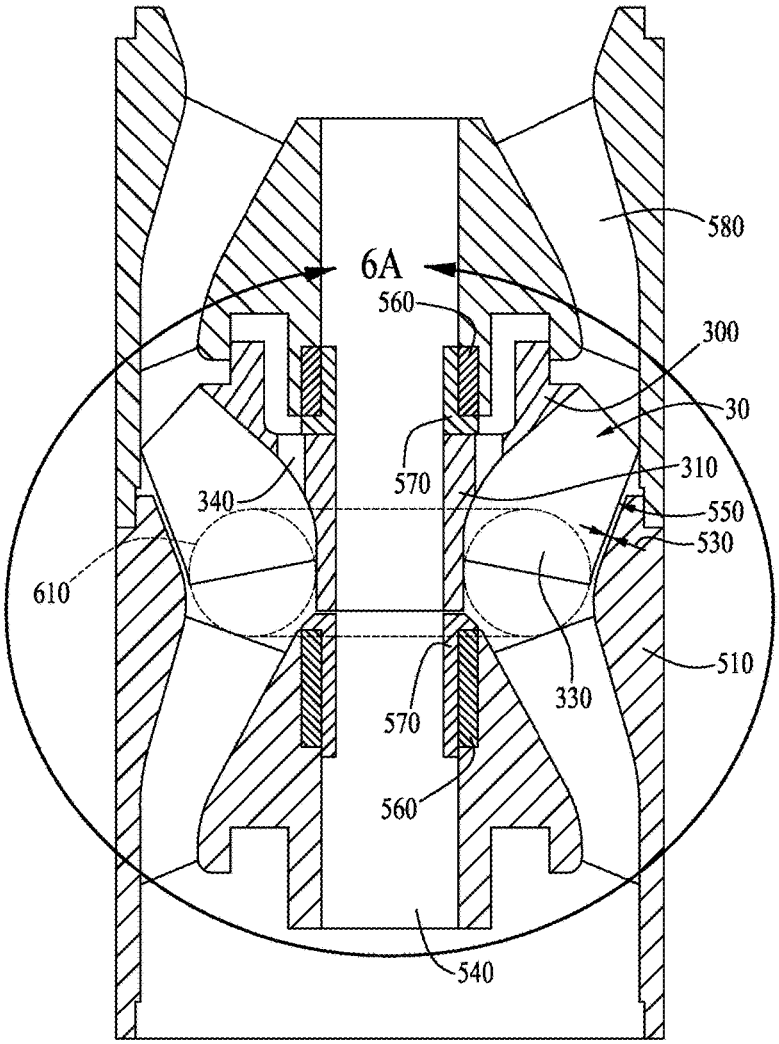
FIG. 6 is a cross sectional view taken along line 6-6 of FIG. 9 of one embodiment of an impeller and diffuser pair in a submersible pump assembly.
Figure 6A:
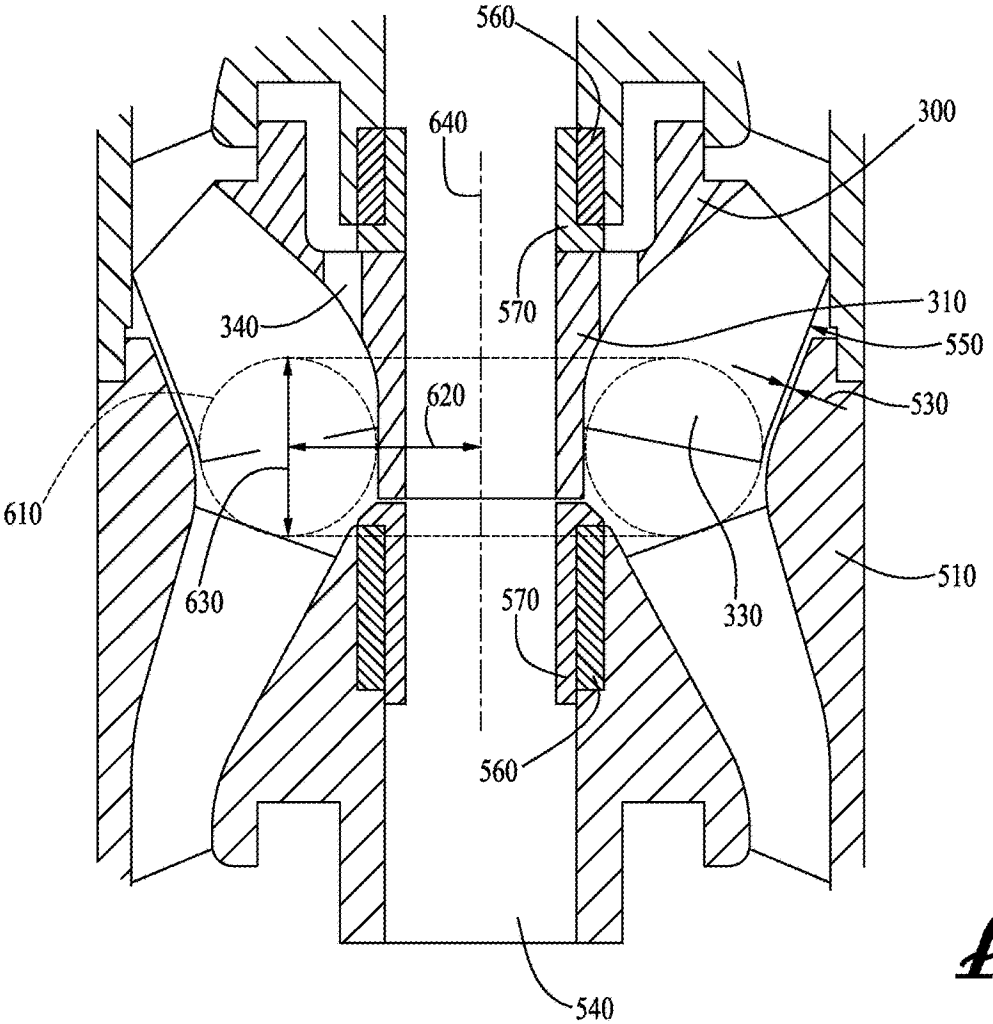
FIG. 6A is an enlarged view of the inlet area of an impeller of illustrative embodiments.

FIG. 6 is a cross sectional view taken along line 6-6 of FIG. 9 of one embodiment of an impeller of an illustrative embodiment. As shown in FIG. 6, impeller 30 is implemented in gas separator 910, but impeller 30 may instead or also be implemented in ESP charge pump 200 and/or ESP primary pump 220. Impeller 30 may be keyed to shaft 540 at hub 310, such that impeller 30 rotates with shaft 540. Impeller 30 is paired with diffuser 510. FIGS. 6, 6A show untruncated vane 330 for illustration purposes, but truncated vane 320 may also be included in impeller 30 in addition to or instead of untruncated vane 330, for example as shown in FIGS. 4A, 4B and/or FIG. 5. In some embodiments, no shroud is present on top side 550 of impeller 30. Single shroud 300 is located on the bottom side of impeller 30.

Gap 530 is between untruncated vane 330 and/or truncated vane 320 (shown in FIG. 5) of impeller 30 and diffuser 510. In some embodiments, gap 530 is an increased clearance gap. The width of gap 530 may be increased by machining the face of diffuser 510 that sits parallel to the face of impeller 30. In some embodiments, increased clearance gap 530 is between about 0.060 inches and about 0.180 inches wide, as required for various gas to liquid ratios. In certain embodiments, increased clearance gap 530 may be wider or narrower depending on the size of the pump and type of well and/or fluid being pumped. In some embodiments, increased clearance gap 530 is at least wider than about 0.020 inches. Increased clearance gap 530 allows the high pressure fluid to circulate and mix with low pressure fluid. Balance hole 340 assist in equalizing the pressure on each side of impeller 30.

In some embodiments, bushing 560 and flanged sleeve 570 located upstream and/or downstream of hub 310 assist in stabilizing impeller 30 and/or holding impeller 30 in place during operation. In some embodiments, bushing 560 and flanged sleeve 570 are located directly upstream and downstream of hub 310. Bushing 560 and/or flanged sleeve 570 may assist in carrying at least a portion of the axial thrust load on impeller 30, such as upthrust and/or downthrust. Bushing 560 and/or flanged sleeve 570 may be made of tungsten carbide, silicon carbide or any other material having similar properties or known to those of skill in the art. In some embodiments, bushing 560 and flanged sleeve 570 comprise abrasion resistant trim.

As shown in FIG. 6, when impeller 30 is in operation, fluid may flow downstream and/or upwards through passage 580 towards successive stages of impeller 30 and diffuser 510 pairs and then to ESP charge pump 200 and/or ESP primary pump 220, eventually passing through production tubing 225 to a pipe, conduit, tank, collection container or other desired location.

In some embodiments, ESP charge pump 200, ESP primary pump 220 and/or gas separator 910 comprises multiple stages of impeller 30 and diffuser 510 pairs, which are stacked on shaft 540. In certain embodiments, ESP charge pump 200 and/or ESP primary pump 220 includes between about 10 and about 100 stages of impeller 30 and diffuser 510 pairs. In some embodiments, gas separator 910 includes between about one and about five stages of impeller 30 and diffuser 510 pairs, depending upon the GVF in the produced fluid. In some embodiments, the inclusion of impeller 30 and diffuser 510 pairs in one component of an ESP assembly obviates the need for their inclusion in another component. For example, in some embodiments, if gas separator 910 includes between about one and about five stages of impeller 30 and diffuser 510 pairs, then impeller 30 and diffuser 510 pairs may not be necessary in ESP charge pump 200 or ESP primary pump 220.

Figure 10:
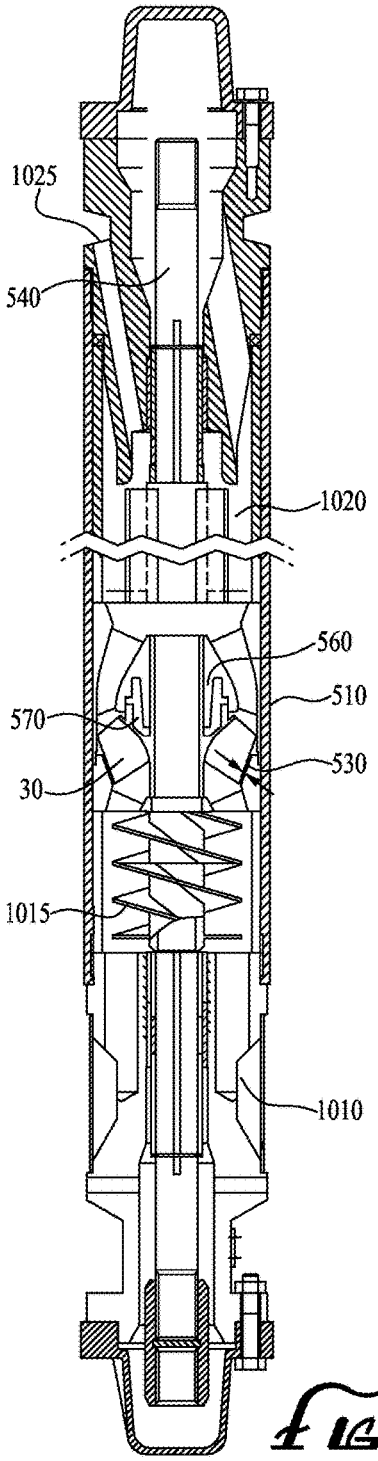
FIG. 10 is a cross sectional view of one embodiment of an exemplary rotary gas separator.
Figure 11:
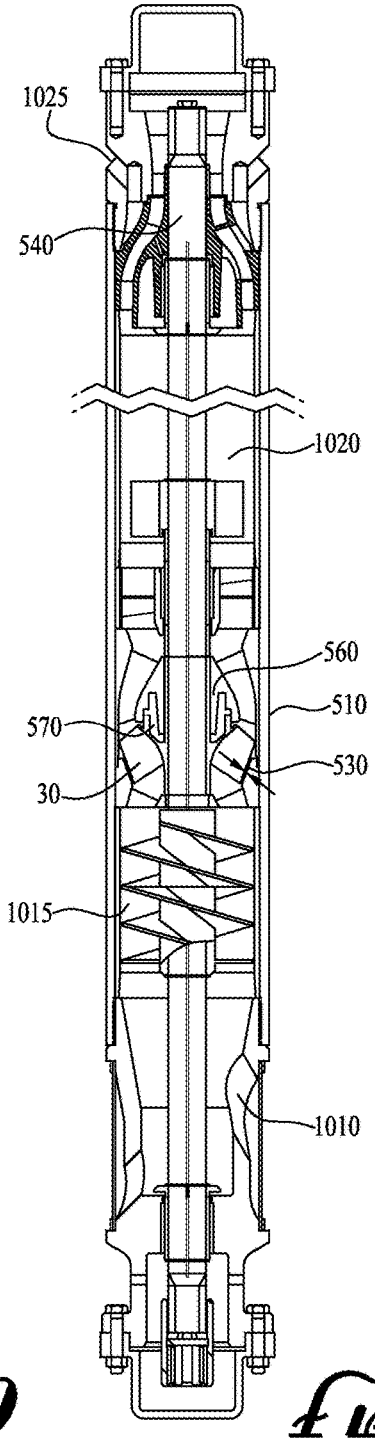
FIG. 11 is a cross sectional view of one embodiment of an exemplary vortex gas separator.

FIG. 10 is an illustrative embodiment of impeller 30 in a rotary gas separator. FIG. 11 is an illustrative embodiment of impeller 30 in a vortex gas separator. As shown in FIGS. 10 and 11, fluid with a high GVF enters port 1010. Once the fluid enters port 1010, it may pass through flow inducer 1015 and proceed to impeller 30. Impeller 30 may rotate with shaft 540 and may homogenize at least a portion of the gas and liquid passing through one or more stages of impeller 30 and diffuser 510. Once the fluid is at least partially homogenized, it proceeds to separation chamber 1020 where unhomogenized gas exits at annulus 1025. The homogenized fluid may then proceed to ESP primary pump 220 with a reduced or eliminated risk of gas locking. In some embodiments, the gas separator of illustrative embodiments may include increased clearance gap 530 between impeller 30 and diffuser 510. In some embodiments, bushing 560 and flanged sleeve 570 may assist in stabilizing impeller 30 and/or holding impeller 30 in place during operation in the gas separator.

Figure 7:
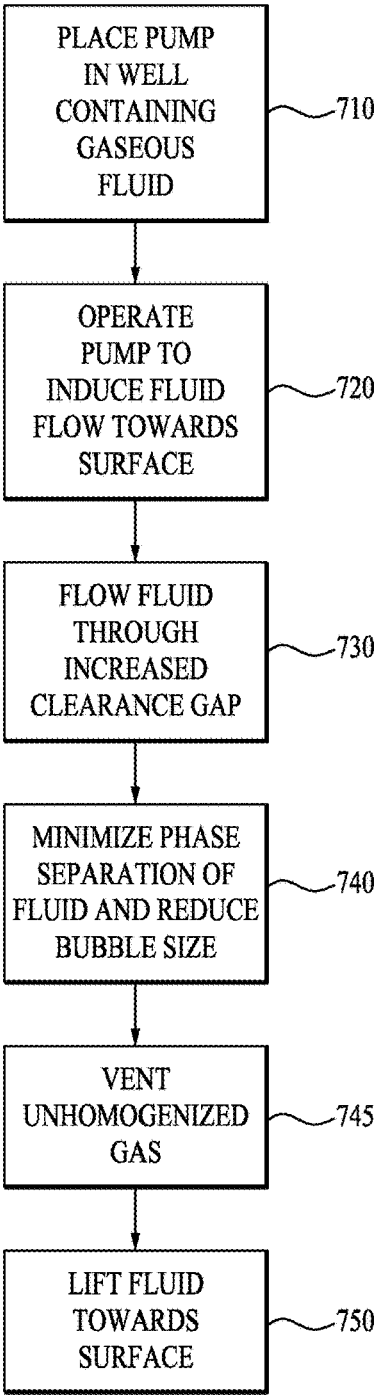
FIG. 7 is a flow chart illustrating an exemplary method of pumping gaseous fluid.
Figure 8A:
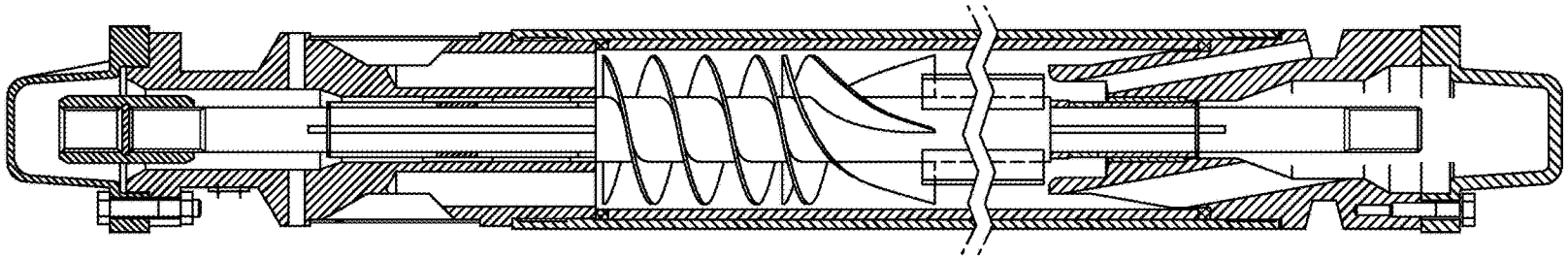
FIG. 8A PRIOR ART
FIG. 8A illustrates a gas separator of the prior art.
Figure 8B:
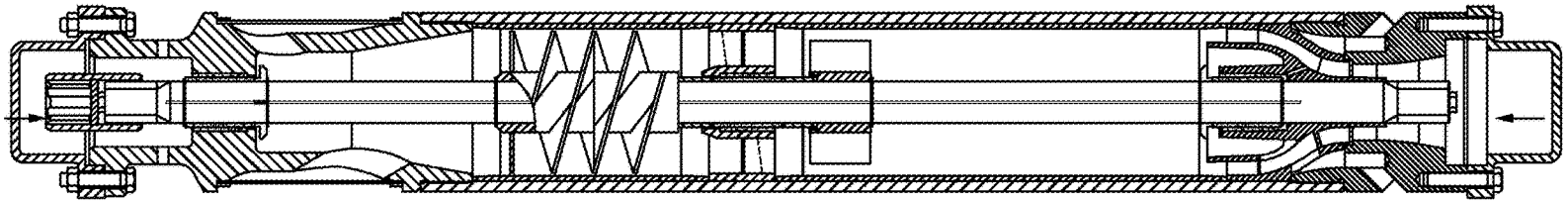
FIG. 8B PRIOR ART
FIG. 8B illustrates a gas separator of the prior art.

FIG. 7 is a flow chart illustrating an exemplary method of pumping gaseous fluid of an illustrative embodiment. At step 710 a centrifugal pump assembly, including ESP primary pump 220, seal section 240, gas separator 910, ESP motor and/or ESP charge pump 200, is placed into a well containing gaseous fluid. The pump may then be operated to induce the fluid to flow towards the surface of the well at step 720. At least a portion of the fluid may flow through increased clearance gap 530 between truncated vane 320 and/or untruncated vane 330, and a diffuser 510, at step 730. At step 740, phase separation of the fluid may be minimized and/or bubble size may be reduced by reducing the pressure differential between the pressure side and suction side of truncated vane 320 and/or untruncated vane 330. In some embodiments, steps 730 and 740 occur in ESP primary pump 220 and/or ESP charge pump 200. In some embodiments, steps 730 and 740 occur in gas separator 910.

In some embodiments, the fluid flow may be caused by rotating an impeller comprising truncated vane 320 and at least two untruncated vane 330 extending substantially upstream from a single shroud 300, wherein a truncated vane 320 sits at a mid-pitch location between untruncated vane 330 starting from the bottom side of impeller 30. In some embodiments, the pressure differential between the pressure side and suction side of truncated vane 320 and/or untruncated vane 330 may be reduced by increasing impeller inlet area 610. In some embodiments, unhomogenized gas may be vented from the pump assembly by gas separator 910 at step 745. Fluid may then be lifted towards the surface, a transport conduit, pipe, tank, collection container, or any other desired location at step 750.

The centrifugal pump of the invention may be suitable for a variety of types of submersible stages known in the art for use in submersible pumps. For example, mixed flow submersible pump stages, as well as radial flow submersible pump stages, may make use of the centrifugal pump of the invention. Both these and other submersible stages suitable for use with an ESP system may benefit from the centrifugal pump of the present disclosure.

The gas separator of the invention may be suitable for a variety of types of submersible stages known in the art for use in submersible pumps. For example, mixed flow submersible pump stages, as well as radial flow submersible pump stages, may make use of the gas separator of the invention. Both these and other submersible stages suitable for use with an ESP system may benefit from the gas separator of the present disclosure.

Various embodiments of the invention may comprise various numbers and spacing of truncated vane 320. ESP primary pump 220, ESP charge pump 200 and/or gas separator 910 may benefit from the semi-open impeller of the invention. One or more impeller/diffuser stages within ESP primary pump 220, gas separator 910 and/or ESP charge pump 200 may benefit from illustrative embodiments of the invention. In some embodiments, the invention described herein may be suitable for pumping fluid having a gas to liquid ratio of up to about 90% by volume, depending on the bubble size of the gas. The impeller of the invention may have between about 1.75 and 2.5 times the size of the inlet area of a convention impeller. In some embodiments, the impeller of the invention may operate at about 8000 to about 12000 suction specific speed. In an illustrative example, in some embodiments incorporating a gas separator, if fluid with a 70% GVF enters port 915, the impeller of the invention may homogenize the fluid such that there is between about 30% and about 40% GVF in separation chamber 1020, which is vented such that the fluid entering ESP primary pump 220 has about 0% GVF. In some embodiments, small quantities of unhomogenized gas may remain in fluid entering ESP primary pump 220, although enough gas may have been homogenized or removed to significantly decrease the risk of gas locking.

While the invention herein disclosed has been described by means of specific embodiments and applications thereof, numerous modifications and variations could be made thereto by those skilled in the art without departing from the scope of the invention set forth in the claims. The embodiments described in the foregoing description are therefore considered in all respects to be illustrative and not restrictive. The scope of the invention is indicated by the appended claims, and all changes that come within the meaning and range of equivalents thereof are intended to be embraced therein.

What is claimed is:

1. An electric submersible pump (ESP) apparatus comprising:

a gas separator located between an ESP seal section and a multi-stage centrifugal pump, the gas separator serving as an intake to the multi-stage centrifugal pump, wherein the gas separator is one of a vortex type or rotary type gas separator, the gas separator comprising:

a rotatable shaft extending through the gas separator;

an intake port;

an impeller inward of a diffuser, the impeller keyed to the rotatable shaft and fluidly coupled to the intake port, the impeller comprising a top side and a bottom side, the top side open to the diffuser, and wherein the impeller further comprises:

a single shroud located on the bottom side of the impeller and arranged radially about a hub that extends from the single shroud in an axial direction perpendicular to the single shroud;

an untruncated vane extending substantially upstream from the single shroud; and a truncated vane extending substantially upstream from the single shroud;

wherein each vane extends substantially upstream along a surface of the hub and each truncated vane sits at a mid-pitch location along the surface of the hub between untruncated vanes starting from the bottom side of the impeller; and wherein the multi-stage centrifugal pump receives substantially homogenized fluid from the gas separator and unhomogenized gas exits the gas separator through the exit port.

2. The ESP of claim 1, wherein the impeller further comprises at least two untruncated vanes extending substantially upstream from the single shroud and at least two truncated vanes extending substantially upstream from the single shroud.

3. The ESP of claim 2, wherein a chord length of the truncated vanes is between 50% and 75% of a chord length of the untruncated vanes.

4. The ESP of claim 2, comprising three truncated vanes and three untruncated vanes.

5. The ESP of claim 2, comprising two truncated vanes and two untruncated vanes.

6. The ESP of claim 2, comprising four truncated vanes and four untruncated vanes.

7. The ESP of claim 1, further comprising a fluid homogenizing clearance gap between the impeller and the diffuser.

8. The ESP of claim 7, wherein the fluid homogenizing clearance gap is between 0.060 inches and 0.180 inches wide.

9. The ESP of claim 1, wherein the impeller is configured to operate at 8000 to 12000 suction specific speed.

10. A system for pumping gaseous fluid from an underground well comprising:

a vortex type gas separator between a centrifugal pump and an electric submersible pump seal section, the gas separator serving as an intake to the centrifugal pump and comprising:

a rotatable shaft extending through the vortex type gas separator;

an intake port;

an impeller fluidly coupled to the intake port and secured to the rotatable shaft, the impeller configured to homogenize at least a portion of a gas and a liquid in a pumped fluid to obtain homogenized fluid, the impeller comprising:

a top side open to the diffuser; and a truncated vane located at a mid-pitch location between at least two untruncated vanes starting from a bottom side of the impeller, wherein each vane extends substantially upstream along a surface of a hub that extends in an axial direction of the impeller;

and a gas separation chamber downstream of the impeller, the gas separation chamber comprising an exit port that vents an unhomogenized gas into an annulus; and the centrifugal pump arranged to receive the homogenized fluid from the gas separation chamber.

11. The system of claim 10, wherein there are three untruncated vanes and three truncated vanes, and wherein each truncated vane sits at a mid-pitch location between the untruncated vanes.

12. The system of claim 10, further comprising a diffuser, wherein a clearance gap between the impeller and the diffuser is between 0.060 inches and 0.180 inches wide.

13. The system of claim 10, wherein a chord length of the truncated vane is between 50% and 75% of a chord length of the untruncated vane.

14. The system of claim 10, further comprising a bushing and a flanged sleeve located directly upstream of the hub of the impeller.

15. The system of claim 10, further comprising a bushing and a flanged sleeve located directly downstream of the hub of the impeller.

16. The system of claim 10, further comprising a first bushing and a first flanged sleeve, wherein the first bushing and the first flanged sleeve are located directly upstream of the hub, and a second bushing and a second flanged sleeve, wherein the second bushing and second flanged sleeve are located directly downstream of the hub.

17. A method for pumping gaseous fluid comprising:

placing an electric submersible pump (ESP) assembly into a well containing a gaseous fluid, the assembly comprising one of a rotary type or a vortex type gas separator between a centrifugal pump and an ESP seal section;

operating the assembly to induce the fluid to flow towards the surface of the well;

minimizing phase separation of the fluid using a plurality of impeller and diffuser pairs located in the one of the rotary type or the vortex type gas separator to obtain substantially homogenized fluid;

removing an unhomogenized gas from the assembly by inertia of rotating motion in a gas separation chamber of the one of the rotary type or vortex type gas separator; and lifting the homogenized fluid to the surface using the centrifugal pump;

wherein the impeller comprises at least two untruncated vanes, and wherein a truncated vane is placed at a mid-pitch location between the at least two untruncated vanes starting from a bottom side of the impeller, wherein each vane extends substantially upstream along a surface of a hub that extends in an axial direction of the impeller.

18. The method of claim 17, wherein the pressure differential is reduced by increasing an inlet area of the impeller.

19. The method of claim 18, wherein the inlet area is increased by replacing an impeller vane of the impeller with a truncated vane.

20. The method of claim 17, further comprising the step of carrying at least a portion of the axial thrust on the centrifugal pump with a flanged sleeve and a bushing located directly upstream of the impeller.

21. The method of claim 17, further comprising the step of causing at least a portion of the fluid to flow through an increased clearance gap between the impeller and a diffuser.

22. The method of claim 21, wherein the increased clearance gap is between 0.060 inches and 0.180 inches wide.

* * * * *